US005092288A

United States Patent [19]

Staerzl

[11] Patent Number: 5,092,288

[45] Date of Patent: Mar. 3, 1992

[54] SPRAY RAIL REED BLOCK

[75] Inventor: Richard E. Staerzl, Fond du Lac, Wis.

[73] Assignee: Brunswick Corporation, Skokie, Ill.

[21] Appl. No.: 662,734

[22] Filed: Feb. 28, 1991

[51] Int. Cl.[5] ..... F02B 33/04

[52] U.S. Cl. ..... 123/73 A; 137/855; 123/73 V; 123/468

[58] Field of Search ..... 123/65 V, 73 A, 73 V, 123/73 C, 468; 137/855, 856

[56] References Cited

U.S. PATENT DOCUMENTS

| | | | |
|---|---|---|---|
| 4,750,464 | 6/1988 | Staerzl | 123/494 |
| 4,763,626 | 8/1988 | Staerzl | 123/438 |
| 4,777,913 | 10/1988 | Staerzl et al. | 123/73 A |
| 4,794,889 | 1/1989 | Hensel | 123/73 SC |
| 4,836,151 | 6/1989 | Litjens et al. | 123/65 V |
| 4,840,148 | 6/1989 | Staerzl | 123/73 A |
| 4,903,649 | 2/1990 | Staerzl | 123/73 A |
| 4,905,638 | 3/1990 | Curtis et al. | 123/73 A |
| 4,922,866 | 5/1990 | Staerzl et al. | 123/73 A |
| 4,955,943 | 9/1990 | Hensel et al. | 123/73 AD |

*Primary Examiner*—David A. Okonsky

*Attorney, Agent, or Firm*—Andrus, Sceales, Starke & Sawall

[57] ABSTRACT

In a two cycle internal combustion engine (10), a reed block (52) has a fuel spray rail flow passage (72) integrally formed therein and supplying fuel atomized by combustion air flow therepast. The fuel spray rail passage extends longitudinally (78) along the apex (60) of a V-shaped reed block (52) at the downstream end thereof, and has discharge ports (74, 76) formed by openings through the sides (56, 58) of the V-shaped member, which ports (74, 76) are opened and closed by the downstream ends of the reed valve flaps (62, 64). When the reed valves are open, air flows across and parallel to the face of the discharge port opening and perpendicular to the direction of fuel flow out of such openings, for enhanced atomization of the fuel. When the reed valves are closed, the downstream ends of the reed valve flaps engage the reed block sides and cover and close the discharge ports such that fuel is blocked from draining into the crankcase.

20 Claims, 3 Drawing Sheets

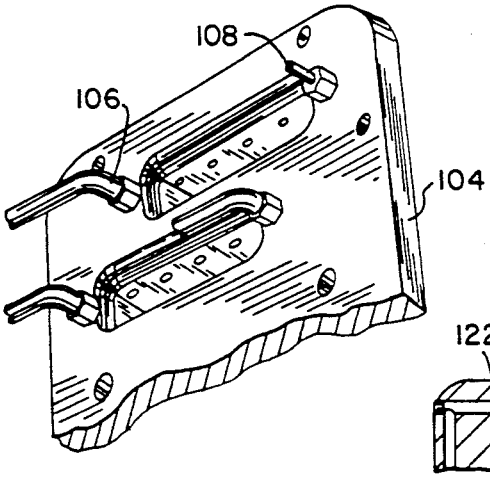
FIG. 6
FIG. 8
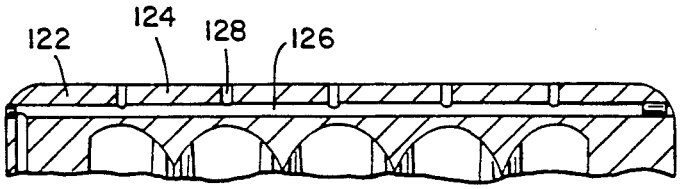
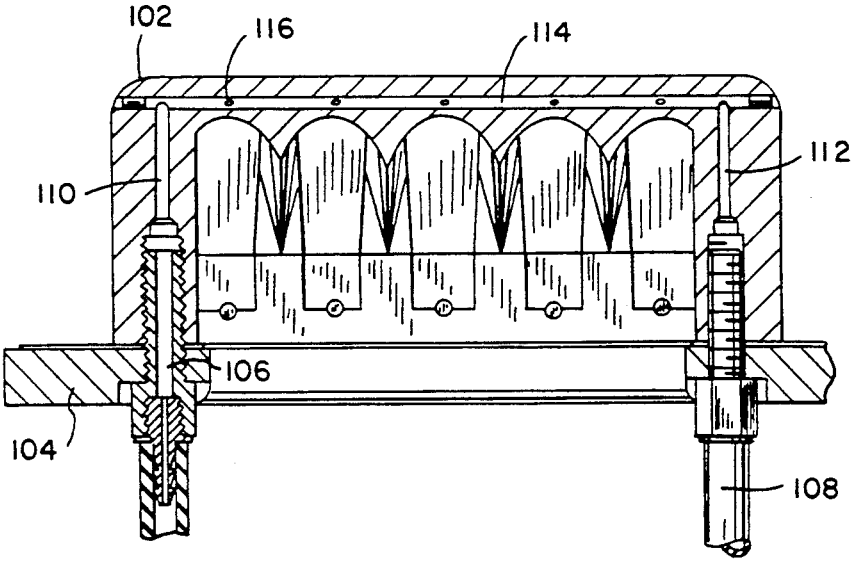
FIG. 7
FIG. 9
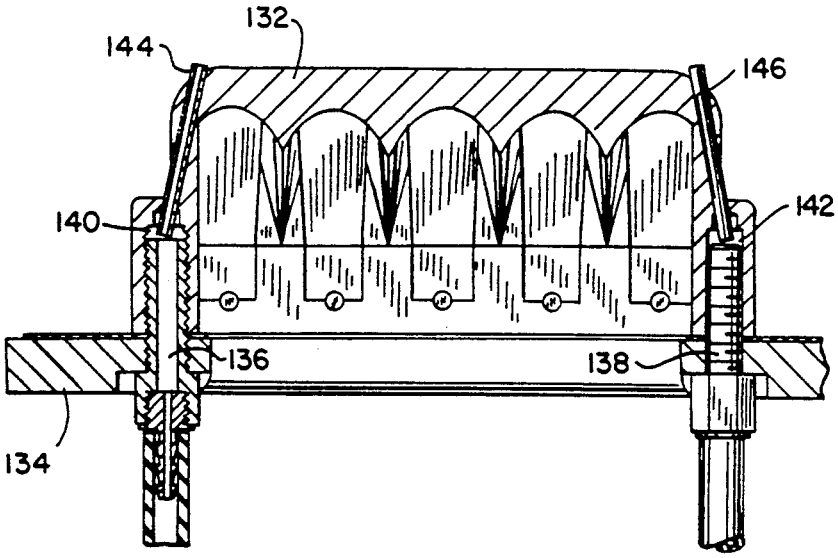

SPRAY RAIL REED BLOCK

BACKGROUND AND SUMMARY

The invention relates to two cycle internal combustion engines, and more particularly to reed blocks therefore.

In a two cycle internal combustion engine, a piston reciprocates in a cylinder between a combustion chamber and a crankcase. A reed block is mounted to the crankcase and has reed valves admitting combustion air to the crankcase. Fuel is supplied by a carburetor or fuel injector upstream of the reed block, or by a fuel injector in the crankcase downstream of the reed block.

The present invention provides fuel-air intake structure affording improved atomization of fuel and uniform distribution of the fuel-air mixture.

BRIEF DESCRIPTION OF THE DRAWINGS

FIG. 6 is a perspective view showing an alternate embodiment.

FIG. 7 is a sectional view of a portion of the structure in FIG. 6.

FIG. 8 is a sectional view showing another alternate embodiment.

FIG. 9 is a sectional view showing another alternate embodiment.

DETAILED DESCRIPTION

Figure 1:
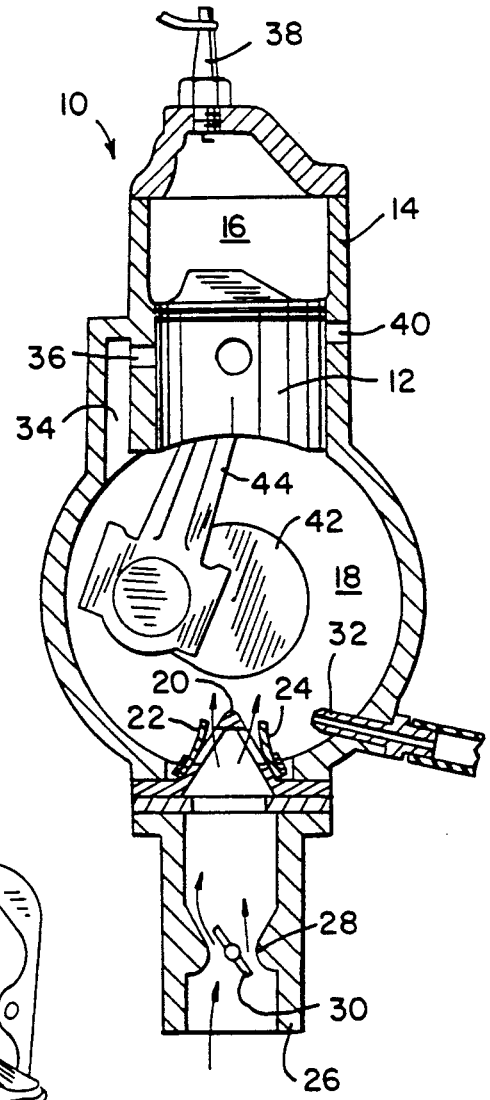
FIG. 1 PRIOR ART
FIG. 1 is a schematic illustration of a two cycle internal combustion engine, as known in the prior art.
Figure 2:
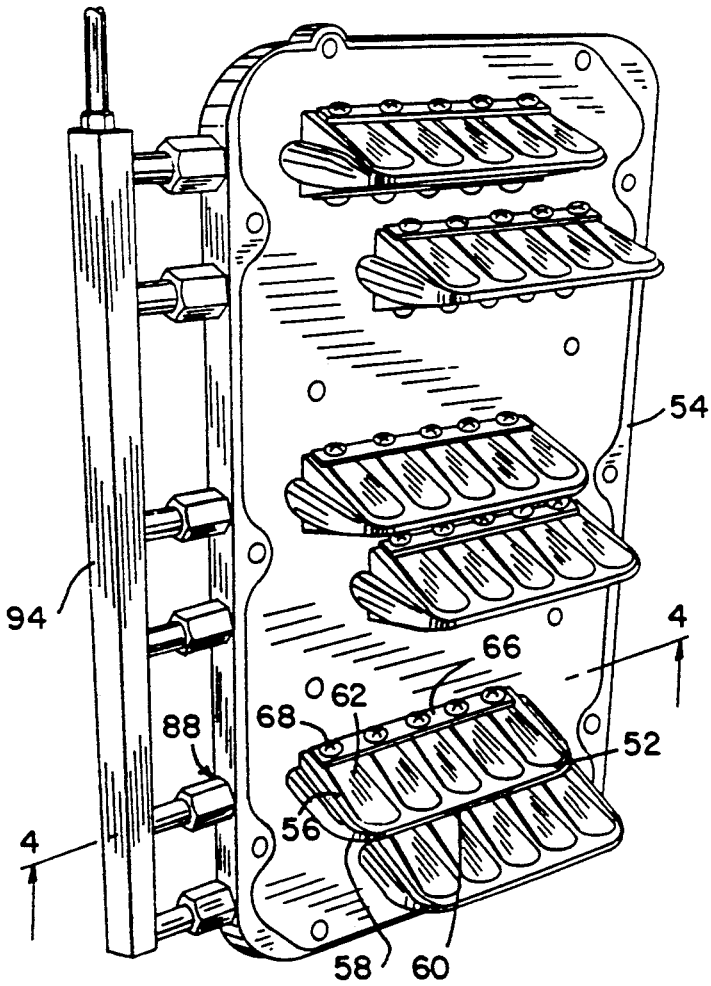
FIG. 2 is a perspective view of reed block structure constructed in accordance with the invention.

FIG. 1 shows one cylinder of a two cycle crankcase compression internal combustion engine 10. A piston 12 is reciprocal in a cylinder 14 between a combustion chamber 16 and a crankcase 18. A reed block 20 is mounted to the crankcase and has reed valves 22, 24 admitting combustion air to the crankcase from intake manifold 26 having venturi 28 and throttle valve 30. Fuel may be supplied by an injector 32 in the crankcase downstream of the reed valves, for example as in U.S. Pat. Nos. 4,750,464, 4,763,626, 4,840,148, 4,903,649, incorporated herein by reference. Alternatively, fuel may be supplied by an injector in manifold 26 upstream of the reed block, for example as in U.S. Pat. Nos. 4,794,889, 4,955,943, incorporated herein by reference. Further alternatively, fuel may be supplied by a carburetor on manifold 26, as in U.S. Pat. Nos. 4,836,151, 4,905,638, incorporated herein by reference. Further alternatively, fuel may be supplied by various combinations of the above, as in U.S. Pat. No. 4,777,913, incorporated herein by reference.

Fuel-air transfer passage 34 extends between crankcase 18 and fuel-air inlet port 36 in cylinder 14 for providing the fuel-air mixture to combustion chamber 16. The mixture is ignited by spark plug 38 and exhausted through exhaust port 40 in cylinder 14. Piston 12 is connected to crankshaft 42 by connecting rod 44.

In operation, piston 12 has a charging stroke in the upward direction compressing the fuel-air mixture in combustion chamber 16 and creating a vacuum in crankcase 18, which vacuum opens reed valves 22, 24 and draws combustion air therethrough into crankcase 18, which air may already be mixed with fuel in manifold 26, or mixes with fuel in crankcase 18 from injector 32. Piston 12 has a power stroke upon combustion of the mixture in chamber 16 by spark plug 38 driving piston 12 downwardly pressurizing crankcase 18 and forcing fuel-air mixture to flow from crankcase 18 through transfer passage 34 to fuel-air inlet port 36 in combustion chamber 16 for repetition of the cycle. The spent combustion products are exhausted through exhaust port 40.

FIGS. 2–5 show reed block structure constructed in accordance with the invention. A plurality of reed blocks such as 52, typically one for each cylinder, are mounted to the engine crankcase by an adaptor plate 54. The reed blocks are identical, and only one will be described. Reed block 52 is a generally V-shaped member having a pair of sides 56, 58 converging at an apex 60 at the downstream end of the reed block. Reed valves are provided by flaps such as 62, 64 having upstream ends mounted to the upstream end of reed block 52 by cross strip 66 and bolts 68. The flaps have downstream ends movable away from the downstream end of the reed block to open the reed valves through openings such as 70 in the side of the reed block, and movable toward the downstream end of the reed block to close the reed valves. The structure thus far described is conventional and known in the prior art.

Figure 3:
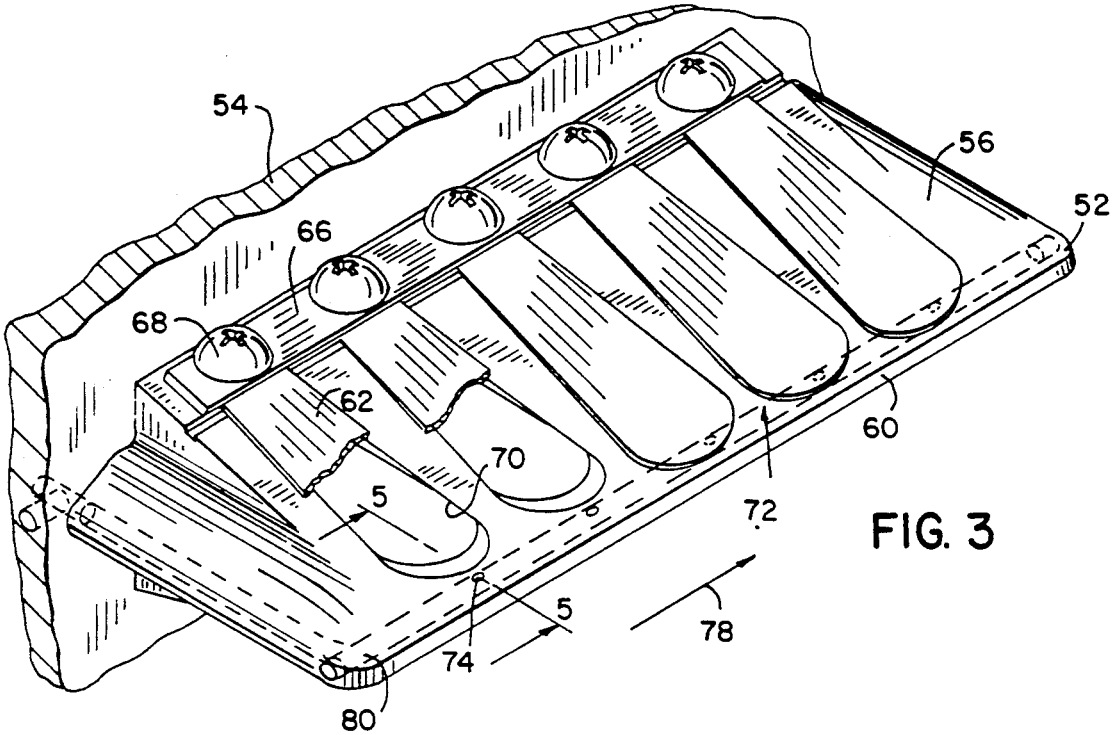
FIG. 3 is an enlarged view of a portion of the structure of FIG. 2.
Figure 4:
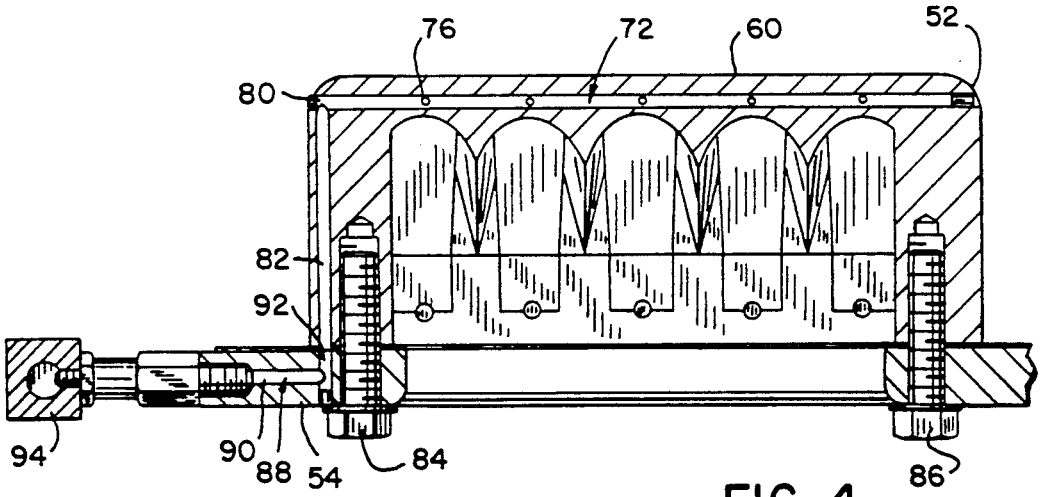
FIG. 4 is an enlarged sectional view taken along line 4—4 of FIG. 2.
Figure 5:
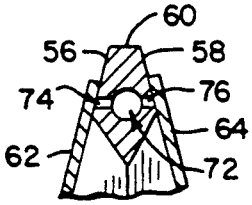
FIG. 5 is a sectional view taken along line 5—5 of FIG. 3.

Reed block 52 has a fuel spray rail 72, FIGS. 3–5, supplying fuel which is atomized by combustion air flow therepast to provide a combustible mixture to crankcase 18. Fuel spray rail 72 is a fuel flow passage integrally formed in the reed block and extending along the reed block and having discharge ports 74, 76, and so on, at the downstream end of the reed block. The fuel spray rail extends along apex 60. Discharge ports 74, 76 are opened and closed by reed valve flaps 62, 64. When the reed valves are open, fuel flows through fuel spray rail flow passage 72 then through discharge ports 74, 76 and into crankcase 18. Combustion air flows across discharge ports 74, 76 and atomizes the fuel. When the reed valves are closed, fuel is blocked from draining into crankcase 18 because reed valve flaps 62, 64 close discharge ports 74, 76 and block communication between discharge ports 74, 76 and crankcase 18. The discharge ports are provided on at least one and preferably both sides 56, 58 of reed block 52 adjacent apex 60. When the reed valves are open, the downstream ends of flaps 62, 64 are spaced away from sides 56, 58, and fuel flows through fuel spray rail flow passage 72 into crankcase 18, and combustion air flows between the downstream ends of flaps 62, 64 and reed block sides 56, 58, and across discharge ports 74, 76, and atomizes the fuel. When the reed valves are closed, the downstream ends of flaps 62, 64 engage reed block sides 56, 58 and cover and close discharge ports 74, 76, such that fuel is blocked from draining into crankcase 18. The discharge ports are provided by one or more openings as shown at 74, 76 through at least one of the reed block sides. Each opening has a face at the respective reed block side 56, 58, such that when the reed valves are open, air flows across and parallel to the face of the opening and perpendicular to the direction of fuel flow out of such opening, for enhanced atomization of the fuel.

V-shaped reed block 52 extends longitudinally along a longitudinal dimension 78 perpendicular to the direction of air flow therethrough and perpendicular to the direction of movement of the downstream ends of flaps 62, 64. Fuel spray rail flow passage 72 extends longitudinally along apex 60. Discharge ports 74, 76 extend laterally from longitudinally extending passage 72. Discharge ports 74, 76 are formed by the noted openings in the reed block sides discharging fuel generally perpendicularly to the direction of air flow therepast. In the preferred embodiment, the openings providing discharge ports 74, 76 are formed by a single passage drilled all the way through the reed block near apex 60 transversely through passage 72 from side 56 all the way to side 58.

The fuel spray rail flow passage includes a downstream section 80 at the downstream end of the reed block and extending along apex 60, and an upstream section 82 at the upstream end of the reed block. Upstream section 82 extends from the upstream end of the reed block to the downstream end, and section 80 extends from section 82 and along the downstream end of the reed block. Section 82 of the fuel flow passage extends along a direction generally parallel to the direction of air flow through reed block 52. Reed block 52 is mounted to adaptor plate 54 by bolts 84, 86. Adaptor plate 54 has a fuel passage 88 extending therethrough and communicating with the upstream end of section 82 of the fuel spray rail flow passage. Fuel passage 88 in adaptor plate 54 has a first section 90 extending generally perpendicularly to the direction of air flow through the reed block, and a second section 92 extending generally parallel to the direction of air flow through the reed block. Fuel flows from first section 90 to second section 92 and then to the fuel spray rail flow passage in the reed block at upstream section 82. Adaptor plate 54 has other fuel passages comparable to passage 88, one for each of the reed blocks, which passages are supplied with fuel from fuel supply rail 94.

FIGS. 6 and 7 show another embodiment having reed block 102 mounted to adaptor plate 104 which has fuel flow passages 106, 108 therethrough supplying fuel to passages 110, 112 in the reed block which in turn supply fuel to passage 114 extending along the downstream end of the reed block and having discharge ports 116 for discharging fuel for atomization by the flow of combustion air therepast.

FIG. 8 shows another embodiment wherein reed block 122 has a downstream apex end with a tip 124 facing the crankcase, and wherein fuel spray rail flow passage 126 extends longitudinally along the downstream apex end and has discharge ports 128 at tip 124. In this embodiment, fuel is discharged through the discharge port openings in a direction generally parallel to the direction of air flow through the reed block.

FIG. 9 shows another embodiment including a reed block 132 mounted to adaptor plate 134 having fuel flow passages 136, 138 therethrough supplying fuel to passages 140, 142 in the reed block which in turn supply fuel to hoses 144, 146 extending through the reed block and discharging fuel at the downstream end of the reed block in a direction generally parallel to the direction of air flow through the reed block.

The embodiments of FIGS. 2–7 are preferred for enhanced fuel atomization, as compared to the embodiments of FIGS. 8 and 9. In FIGS. 2–7, fuel is discharged along a direction perpendicular to the direction of combustion air flow therepast, such that the combustion air sweeps across and parallel to the face of the discharge port opening and improves fuel atomization. In FIGS. 8 and 9, the fuel discharge ports discharge the fuel in a direction generally parallel to the direction of combustion air flow.

It is recognized that various equivalents, alternatives and modifications are possible within the scope of the appended claims.

I claim:

1. In a two cycle internal combustion engine having a piston reciprocal in a cylinder between a combustion chamber and a crankcase, a reed block mounted to said crankcase and having one or more reed valves admitting combustion air to said crankcase, said reed block having a fuel spray rail supplying fuel atomized by combustion air flow therepast to provide a combustible mixture to said crankcase.

2. The invention according to claim 1 wherein said fuel spray rail comprises a fuel flow passage integrally formed in said reed block.

3. The invention according to claim 1 wherein said reed block has an upstream end and a downstream end, said one or more reed valves comprise flaps having upstream ends mounted to said upstream end of said reed block, said flaps having downstream ends movable away from said downstream end of said reed block to open the reed valves, and movable toward said downstream end of said reed block to close the reed valves, and wherein said fuel spray rail extends along said reed block and has discharge ports at said downstream end of said reed block.

4. The invention according to claim 3 wherein said reed block comprises a generally V-shaped member having a pair of sides converging at an apex at said downstream end, and said fuel spray rail comprises a fuel flow passage integrally formed in said apex.

5. The invention according to claim 4 wherein said discharge ports are opened and closed by said reed valves, such that when said reed valves are open fuel flows through said fuel spray rail flow passage then through said discharge ports and into said crankcase, and wherein combustion air flows across said discharge ports and atomizes said fuel, and such that when said reed valves are closed fuel is blocked from draining into said crankcase because said closed reed valves block communication between said discharge ports and said crankcase.

6. The invention according to claim 4 wherein said discharge ports are on at least one of said sides and adjacent said apex, such that when said reed valves are open said downstream ends of said flaps are spaced away from said sides and fuel flows through said fuel spray rail flow passage then through said discharge ports and into said crankcase, and wherein combustion air flows between said downstream ends of said flaps and said sides, and across said discharge ports and atomizes said fuel, and such that when said reed valves are closed said downstream ends of flaps engage said sides and cover and close said discharge ports such that fuel is blocked from draining into said crankcase.

7. The invention according to claim 6 wherein said discharge ports comprise one or more openings through at least one of said sides, each opening having a face at said side, such that when said reed valves are open air flows across and parallel to said face of said opening and perpendicular to the direction of fuel flow out of said opening, for enhanced atomization of said fuel.

8. The invention according to claim 4 wherein said apex has a tip facing said crankcase and wherein said discharge ports are at said tip.

9. The invention according to claim 3 wherein said fuel spray rail comprises a flow passage integrally formed in said reed block and having a first section extending from said upstream end to said downstream end, and a second section extending from said first section and along said downstream end.

10. In a two cycle internal combustion engine having a piston reciprocal in a cylinder between a combustion chamber and a crankcase, a reed block mounted to said crankcase and having an upstream end and a downstream end and having one or more reed valves admitting combustion air to said crankcase, said reed block comprising a generally V-shaped member having a pair of sides converging at an apex at said downstream end, said reed block having a fuel spray rail supplying fuel through said reed block and having one or more discharge ports at said downstream end discharging fuel which is atomized by combustion air flow therepast to provide a combustible mixture to said crankcase.

11. The invention according to claim 10 wherein said fuel spray rail comprises a fuel flow passage through said reed block and including a downstream section at said downstream end of said reed block and communicating with said one or more discharge ports, and including an upstream section at said upstream end of said reed block for receiving fuel.

12. The invention according to claim 11 wherein said fuel flow passage extends from said upstream end to said downstream end along a direction generally parallel to the direction of air flow through said reed block.

13. The invention according to claim 12 wherein said one or more reed valves comprise flaps having upstream ends mounted to said upstream end of said reed block, said flaps having downstream ends movable away from said downstream end of said reed block to open the reed valves, and movable toward said downstream end of said reed block to close the reed valves, and wherein said V-shaped member extends longitudinally along a longitudinal dimension perpendicular to the direction of air flow therethrough and perpendicular to the direction of movement of said downstream ends of said flaps, and wherein said fuel spray rail flow passage comprises a first section extending from said upstream end of said reed block to said downstream end of said reed block generally parallel to the direction of air flow through said reed block, and a second section extending longitudinally along said apex.

14. The invention according to claim 13 wherein said reed block is mounted to said crankcase by an adaptor plate, and wherein said adaptor plate has a fuel passage extending therethrough communicating with said upstream end of said fuel spray rail flow passage.

15. The invention according to claim 14 wherein said flow passage through said adaptor plate extends generally parallel to the direction of air flow through said reed block.

16. The invention according to claim 15 wherein said fuel flow passage through said adaptor plate has a first section extending generally perpendicularly to the direction of air flow through said reed block, and a second section extending generally parallel to the direction of air flow through said reed block, and wherein fuel flows from said first section to said second section and then to said fuel spray rail flow passage in said reed block.

17. The invention according to claim 10 wherein said fuel spray rail comprises a fuel flow passage integrally formed in said reed block.

18. In a two cycle internal combustion engine having a piston reciprocal in a cylinder between a combustion chamber and a crankcase, a reed block mounted to said crankcase and having one or more reed valves admitting combustion air to said crankcase, said reed block having an upstream end and a downstream end and having a pair of sides converging at an apex at said downstream end and forming a generally V-shaped member, said one or more reed valves comprising flaps having upstream ends mounted to said upstream end of said reed block and having downstream ends movable away from said downstream end of said reed block to open the reed valves, and movable toward said downstream end of said reed block to close the reed valves, said reed block extending longitudinally along a longitudinal dimension perpendicular to the direction of movement of said downstream ends of said flaps, a fuel spray rail comprising a fuel flow passage integrally formed in said apex at said downstream end of said reed block and extending longitudinally along said apex.

19. The invention according to claim 18 wherein said discharge ports comprise a plurality of lateral passages extending laterally from said longitudinally extending fuel spray rail flow passage.

20. The invention according to claim 19 wherein said discharge ports comprise openings discharging fuel generally perpendicularly to the direction of air flow therepast.

* * * * *